United States Patent [19]

Reichert

[11] 4,014,115

[45] Mar. 29, 1977

[54] DECORATOR HEEL/SHOE COMBINATION

[76] Inventor: Robert J. Reichert, 118 Prospect St., Clyde, Ohio 43410

[22] Filed: June 9, 1975

[21] Appl. No.: 585,386

[52] U.S. Cl. ..... 36/137; 36/34 R
[51] Int. Cl.[2] ..... A43B 23/00
[58] Field of Search ..... 36/42, 2.5 K

[56] References Cited

UNITED STATES PATENTS

| | | | |
|---|---|---|---|
| 1,363,643 | 12/1920 | Clifton | 36/42 |
| 1,933,243 | 10/1933 | DeMerolis et al. | 36/2.5 K |
| 2,806,302 | 9/1957 | Sharpe | 36/42 X |
| 2,941,315 | 6/1960 | Irving et al. | 36/2.5 K X |
| 2,976,622 | 3/1961 | Shearouse | 36/2.5 K |
| 3,188,755 | 6/1965 | Cortina | 36/42 |
| 3,893,247 | 7/1975 | Dana | 36/2.5 K |

FOREIGN PATENTS OR APPLICATIONS

| | | | |
|---|---|---|---|
| 570,614 | 9/1958 | Belgium | 36/42 |
| 1,072,485 | 3/1954 | France | 36/2.5 K |
| 444,392 | 3/1936 | United Kingdom | 36/2.5 K |

*Primary Examiner*—Alfred R. Guest
*Attorney, Agent, or Firm*—Paul F. Stutz

[57] ABSTRACT

Shoe and heel structure features a combination of functions including heel removability and decoration, utilizing a sliding, removably mating engagement of the heel with the shoe and means for effecting continuous or intermittent light emission within the heel structure; all coupled with translucent characteristic of the heel and coloration as to provide, in combination, a unique decorative character, coupled with changeability and thereby decorator flexibility.

1 Claim, 6 Drawing Figures

DECORATOR HEEL/SHOE COMBINATION

The present invention relates to a novel decorator heel and shoe structure.

Shoes and heels therefor need minimal introductory explanation. It is known that heels serve a variety of purposes including (1) elevation of the heel or rear of the foot of the wearer to lend height to the wearer, (2) providing an additional thickness other than that of the sole to improve wearability, (3) providing a cushion function for shock encountered in the walking or running of the wearer and (4) appearance.

Heels frequently require repair due to undue wear at one region or corner by reason of the particular walking characteristics of the wearer. Eventually, the heel has to be removed and replaced by a new heel. This is accomplished at a shoe repair shop employing craftsmen who are skilled in the repair of the shoe and removal and replacement of the heel. These operations require necessarily special tools, special machinery and, of course, the attendant expenses, including cost of labor.

It is an object of the present invention to provide a heel/shoe structure in which the heel is easily removable from the shoe or readily disengageable such that a replacement heel can be easily applied by the wearer or user of the heel/shoe structure of the present invention.

It is also an object of the present invention to provide such a heel/shoe structure in which the necessity for conventional heel replacement labor and craftsmenship is obviated.

Shoes and, as well, heels are manufactured not only with function in mind but decoration, esthetic appeal and visual attractiveness.

It is an object of the present invention to provide a heel/shoe structure which, in addition to replaceability and removability, provides unique decorator possibilities in that several different heels may be possible for the same shoe, whereby the decoration possibilities are infinitely more varied.

The heel/shoe structure as envisioned by me embodies unique visual appearance, a novel illumination mechanism contributing to the visual appeal and additionally features a configuration and design such that the heel is removably attachable to the shoe of complementary configuration; all providing features of advantage and design as will become apparent from the foregoing and the more detailed description to follow.

It is an object of the present invention to provide a structure as described characterized in that the heel may be easily and conveniently removed by the user or wearer, permitting installation of a substitute heel of similar or varied decorative features without the employment of any special tool, skill or machinery.

It is another object of the present invention to provide a structure as described which additionally includes unique decorative features which are visually attractive as provided by a particular selection of the material of construction and additionally incorporation of a special design including interior illumination means as well as switch and power means, permitting maximization of the illumination and decorative function.

The foregoing as well as other objects of the present invention will become apparent to those skilled in the art from the following detailed description taken in conjunction with the annexed sheet of drawings on which there is presented, for purposes of illustration only, a principal embodiment and several secondary embodiments of the heel/shoe structure of the present invention.

The heel/shoe structure of the present invention in its most basic form includes a heel structure and cooperating shoe configuration, permitting sliding engagement and removability coupled with interior illumination capabilities by means of recessed batteries, light bulb and appropriate circuitry.

Figure 1:
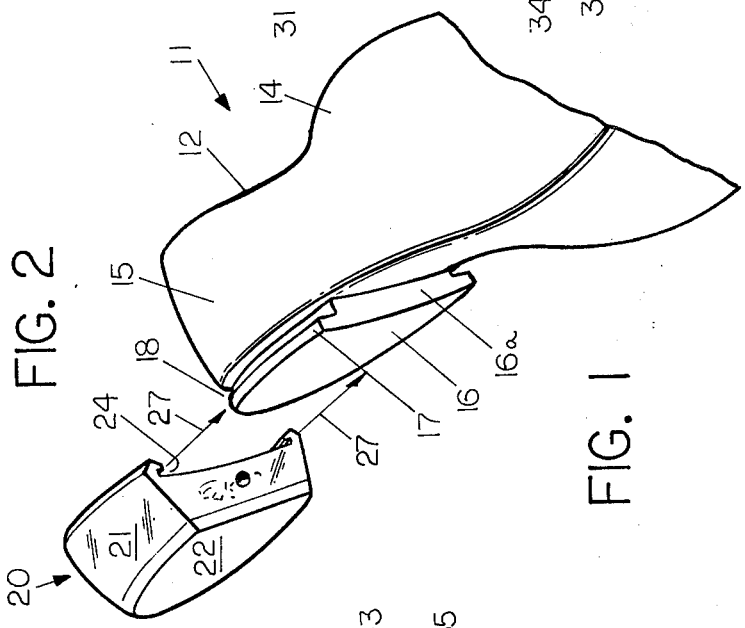
FIG. 1 is an exploded, perspective view of a shoe and heel structure of the present invention, with the heel shown disconnected from and in spaced relationship with the shoe itself.

Referring now more specifically to the drawings, there is shown in FIG. 1 a shoe 11 comprising a principal body 12 featuring a sole 13 and foot enclosure 14 inclusive of a heel region 15. To the sole 13, beneath the heel region, is attached a connector 16 featuring an annular edge 17 which extends about the connector and spaced from the heel region 15 by an annular groove 18. Situated to the rear of the shoe 11 is a heel 20 including a principal body 21, preferably of translucent hardened plastic or resin. The body 21 includes a cushion layer 22 adhesively secured to its bottom face or integrally a part of the bottom of the body. The heel body includes an upper edge 23 which is complementary to the annular groove 18 and annular edge 17 at the rear of the shoe 11. Thus, the upper edge 23 of the heel includes an annular groove 24 and tongue 25; the tongue 25 fitting into the groove 18, while edge 17 of the shoe 11 fits into the groove 24 of the heel, providing a sliding mating engagement as the heel is moved onto the shoe in the manner and direction indicated by the arrows 27.

Figure 2:
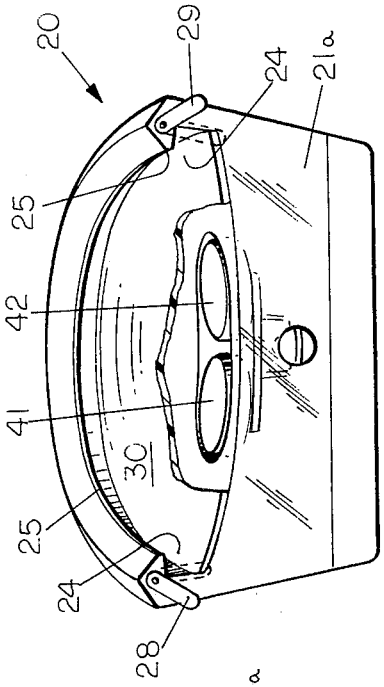
FIG. 2 is a front elevation view of a heel structure in accordance with the present invention.
Figure 3:
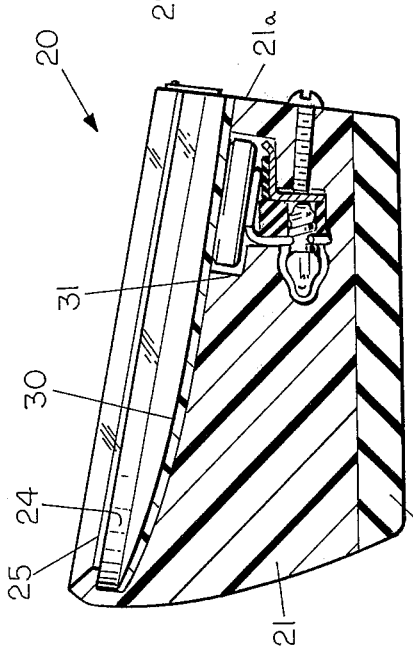
FIG. 3 is a schematic side elevation view, partly in section, of the heel structure of FIG. 2.

The heel 20, as shown in FIG. 2, includes fasteners 28 and 29 proximate the groove 24 on the left and right. The fasteners 28 and 29 pivot between a position covering the groove region 24 (see dotted outline) and a position not covering the groove region 24 (see full line outline) such that the shoe can be fully engaged with the connector 16 and consequently the shoe 11. With the fasteners pivoted to the operative position, an engagement with the edge 17 precludes removal of the heel. When the heel is fully engaged, the forward face of the heel 21*a* is flush with the forward face 16*a* of the connector 16.

Figure 4:
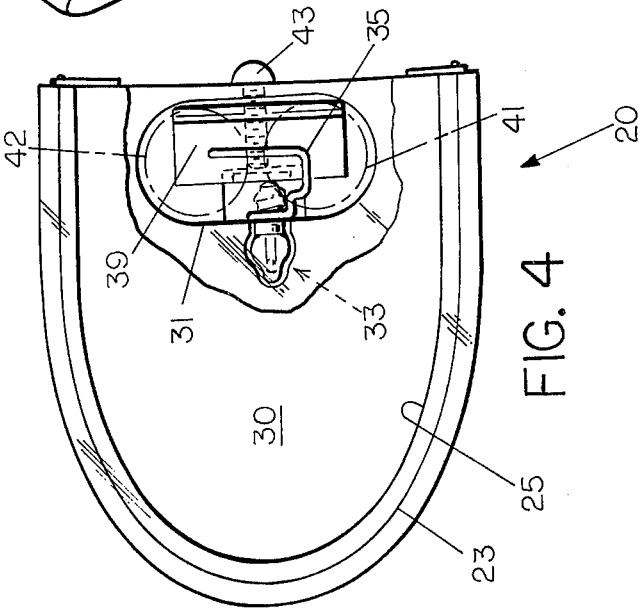
FIG. 4 is a top plan view of the heel shown in FIGS. 2 and 3, with part of the heel broken away in order to show the interior structure.

With the heel 20 fully engaged with the connector 16, the lower surface of the latter flushly abuts a liner 30 located on the top surface of the heel 20 but recessed therein, as shown, just below the tongue 25 and groove 24. A cavity 31 is molded or otherwise formed in the heel 20 as molded, cast or otherwise formed. The liner 30 covers the cavity which houses the illuminating means in a manner more specifically disclosed in FIG. 5. The cavity 31 includes an upper region 32 for housing batteries and electrical connectors and a lower region 33 for the light bulb 34 and additional electrical connectors. An electrical connector element 35 encircles the base 34*a* of the bulb and extends upwardly, as shown, then to the right (or forwardly) and then laterally across the width of the shoe as shown in FIG. 4. Another connector element 36 contracts the button terminal of the bulb; this connector extending vertically up and then to the right or forwardly, terminating in an upturned hook segment 36*a*. A spacer/insulator 37 and a similar spacer/insulator 38 are located about the base 34*a* of the bulb to insure separation of the connector elements or conductor elements 35 and 36. Another insulator member 39 in cavity 32 separates connectors 35 and 36, as shown. Spacer/insulators 37, 38 and 39 are shown as separate pieces but may be molded as one piece if desired.

A pair of disk batteries 41 and 42 are situated in the upper cavity region 32 and rest upon the connector 35 sufficiently to complete electrical contact with the bulb base. Screw 43 when turned clockwise urges connector 36 against the light bulb button terminal; connector 36 extending to turnup 36*a*, slightly spaced from the one terminal of the batteries 41 and 42. With the screw 43 turned clockwise to establish contact as described, the flow of electricity from the batteries in the light bulb is still prevented by the space or void between edge 36*a* and the batteries 41 and 42. The closing of this space or void to complete the circuit is effected by the weight of the wearer, exerting pressure through the connector 16 and the heel upper liner 30 compressing the battery, causing it to move downward slightly to contact the upturned segment 36*a* of connector 36. This weight, accomplishing completion of the circuit, occurs with each step of the wearer when the weight of the wearer is brought to bear in the manner described. With this arrangement, the light bulb flashes intermittently, providing, in part, a unique decorative function of the heel/shoe structure of the present invention.

The heel proper 21 is formed of a clear to translucent molded plastic such as a vinyl resin, a ployester resin or a methacrylate, such as methyl methacrylate sold under the trade name "Lucite". These plastics in the molded or cast form are relatively hard and can be formulated to any degree of translucence and embodying various coloration-imparting pigments including special sparkling effects. It is most desirable that the heel 20 include a lower layer 22 which is somewhat softer in composition than the principal body 21. A somewhat softer vinyl can be employed for this purpose, serving thereby to eliminate shock and cushion the contact in walking. This layer may be a molded or cast plastisol integrally secured to the heel body or molded separately and then adhesively secured, using, for example, an epoxy-type glue. Natural and synthetic elastomers and rubbers may be used instead of the vinyls. The connector member 16 is preferably at least somewhat resilient in order that the heel pressure can be transmitted through it to compress the battery pair 41 and 42 against the connector 36*a*. The connector 16 can be formed integrally with the sole out of a molded, semi-resilient vinyl or it may be separately molded out of hard rubber and adhesively secured or stitchingly secured to the sole and/or last of the shoe in conventional fashion.

The heel formed of plastic of clear to translucent character serves, by reason of the size and thickness, to amplify the light emitted by the bulb at the surface of the heel, yielding a strikingly attractive and unique effect to onlookers or passerbys.

The heel/shoe structure of the present invention permits a considerable variation in the decorator and style function. Thus, with each pair of shoes, several and as many as 6 or 7 heels can be purchased at the same time or intermittently as desired or needed. With several heels, the shoe structure of the present invention is of greatly increased life since the heels may be readily interchanged by the wearer to coordinate with the color scheme of the clothes worn by the wearer.

Figure 6:
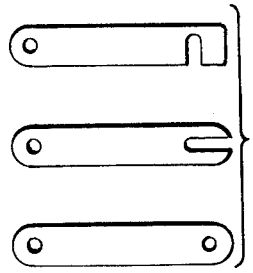
FIG. 6 is a plan view of several attachment means for holding the heel and shoe in assembled relationship.

In FIG. 6, there are shown several diferent kinds of fastener devices which may be employed. The notch fasteners provide an arrangement for engagement with a stud or screw or nail on the face 16*a* of the connector, providing a more secure fastening of the heel.

Figure 5:
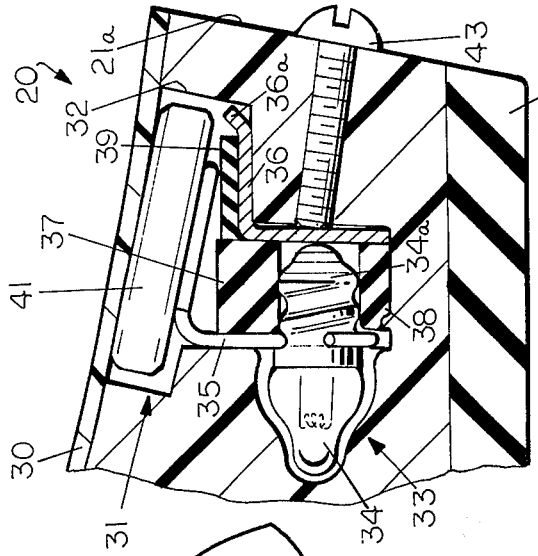
FIG. 5 is a view of a segment of the heel shown in FIG. 3 but greatly enlarged in order to better illustrate in detail the illuminating means of the present invention.

The illuminating means comprising the flashlight battery, electrical conductors, disk batteries and control screw has been found to provide a very simple yet effective arrangement for achieving intermittent illumination or flashing. It will be appreciated, of course, that the circuitry may be modified to provide either "on" or "off"; in other words, closing or opening of the circuit responsive to the screw switch 43 or a similar slide switch if desired. With such arrangement, activation of a suitable switch would connect the power source to the bulb to provide a continuous illumination. It is also possible within the purview of the present invention to include a circuitry which combines the just-described features, thus utilizing a three-position switch arrangement, in which one position would be off, the second position would be on and the third position would provide the circuitry and connection of the appropriate connectors, battery and bulb as illustrated in FIG. 5.

Various batteries, connectors and switches are readily available and accordingly detailed discussion of these known components is believed unnecessary. Within the spirit of the patent statutes, there has been disclosed the best mode or design for these components incorporated into the heel/shoe structure in an operable manner.

Other obvious modifications in structure, variations and arrangements and selections of material may be made without departing from the spirit and scope of the present invention unless such modifications or changes would violate the scope of the appended claims.

I claim:

1. A shoe comprising:

1. a principal body including a sole, an upper attached foot-enclosing member and a heel-engaging connector, and 2. a removable heel adapted to removably engage said connector, said heel being formed of a hardened translucent plastic, said heel having a vertical forward face and an upper horizontal face in flush engagement with said connector, said heel including two formed interconnecting recesses or cavities, one of said cavities being proximate said upper surface and containing at least one disk-type battery having a central planar terminal and an edge terminal, said lower cavity containing a bulb energizable by said battery and having two terminals, a first connector encircling said bulb base to contact one of said bulb terminals and extending to said upper cavity to engage said planar terminal of said battery, and a second connector extending upwardly to proximate said disk-type battery edge terminal and spaced therefrom, said second connector being shiftable into and out of contact with said other terminal of said bulb, a laterally movable screw extending from said forward face to said lower inner cavity and movably operative to shift said second connector against said other bulb terminal, said battery being shiftable by the weight of the shoe wearer to accomplish contact between said battery edge terminal and said second conductor and thereby illuminate said bulb only if said screw is holding said second connector against said other bulb terminal.

* * * * *